US008470762B2

(12) United States Patent
Broze et al.

(10) Patent No.: US 8,470,762 B2
(45) Date of Patent: Jun. 25, 2013

(54) FABRIC SOFTENING COMPOSITIONS COMPRISING POLYMERIC MATERIALS

(75) Inventors: Guy Broze, Grace-Hollogne (BE); Alain Jacques, Blegny (BE); Alexandrine Tuzi, Ans (BE); Georges Yianakopoulos, Liege (BE)

(73) Assignee: Colgate-Palmolive Company, New York, NY (US)

( * ) Notice: Subject to any disclaimer, the term of this patent is extended or adjusted under 35 U.S.C. 154(b) by 975 days.

(21) Appl. No.: 11/756,267

(22) Filed: May 31, 2007

(65) Prior Publication Data

US 2008/0295256 A1 Dec. 4, 2008

(51) Int. Cl.
*C11D 3/37* (2006.01)

(52) U.S. Cl.
USPC ..... 510/515

(58) Field of Classification Search
USPC ..... 510/515
See application file for complete search history.

(56) References Cited

U.S. PATENT DOCUMENTS

| | | | |
|---|---|---|---|
| 3,240,740 | A | 3/1966 | Karl et al. |
| 3,816,321 | A | 6/1974 | Kleinschmidt |
| 4,464,271 | A | 8/1984 | Munteanu et al. |
| 4,806,345 | A | 2/1989 | Bhattacharyya |
| 4,844,823 | A | 7/1989 | Jacques |
| 5,000,958 | A | 3/1991 | Fountain et al. |
| 5,137,646 | A | 8/1992 | Schmidt et al. |
| 5,476,598 | A | 12/1995 | Schramm |
| 5,501,806 | A | 3/1996 | Farooq et al. |
| 5,656,585 | A | 8/1997 | Grandmaire et al. |
| 6,042,792 | A | 3/2000 | Shefer et al. |
| 6,075,093 | A | 6/2000 | Rodrigues |
| 6,620,777 | B2 | 9/2003 | Heibel et al. |
| 6,713,410 | B1 | 3/2004 | Perring et al. |
| 6,864,223 | B2 | 3/2005 | Smith et al. |
| 2003/0226210 | A1 | 12/2003 | Pacha et al. |
| 2004/0142828 | A1 | 7/2004 | Popplewell et al. |
| 2005/0002892 | A1* | 1/2005 | Khan et al. ..... 424/70.17 |
| 2005/0175568 | A1* | 8/2005 | Asari et al. ..... 424/70.12 |
| 2005/0229327 | A1* | 10/2005 | Casella et al. ..... 8/115.51 |
| 2006/0039934 | A1 | 2/2006 | Ness et al. |
| 2006/0135399 | A1 | 6/2006 | Grandmaire et al. |
| 2007/0138672 | A1* | 6/2007 | Lee et al. ..... 264/4.1 |
| 2007/0185003 | A1 | 8/2007 | Iavarone et al. |
| 2007/0187003 | A1 | 8/2007 | Takashima et al. |
| 2007/0219111 | A1 | 9/2007 | Ward |
| 2008/0022464 | A1 | 1/2008 | Lambert et al. |

FOREIGN PATENT DOCUMENTS

| | | | |
|---|---|---|---|
| CA | 1 111 616 | | 11/1981 |
| DE | 4313085 | A1 | 10/1994 |
| EP | 1 520 909 | A | 4/2005 |
| EP | 1533364 | | 7/2008 |
| GB | 1 207 727 | A | 10/1970 |
| GB | 2432844 | | 6/2007 |
| WO | WO 90/12862 | | 11/1990 |
| WO | 9424999 | A | 11/1994 |
| WO | 0006690 | A | 2/2000 |
| WO | WO 00/68352 | | 11/2000 |
| WO | 02057400 | A | 7/2002 |
| WO | 03102043 | A | 12/2003 |
| WO | 2006121639 | A | 11/2006 |
| WO | 2007084596 | A | 7/2007 |

OTHER PUBLICATIONS

International Search Report dated Nov. 25, 2008.
Escher et al., "A Quantitative Study of Factors that Influence the Substantivity of Fragrance Chemicals on Laundered and Dried Fabrics", *Journal of American Oil Chemists's Society*, vol. 71, No. 1, pp. 31-40, (1994).
File History for U.S. Appl. No. 12/835,809, filed Jul. 14, 2010.
File History for U.S. Appl. No. 12/835,801, filed Jul. 14, 2010.
File History for U.S. Appl. No. 12/835,799, filed Jul. 14, 2010.
File History for U.S. Appl. No. 12/835,795, filed Jul. 14, 2010.

* cited by examiner

*Primary Examiner* — John R Hardee
(74) *Attorney, Agent, or Firm* — Michael F. Morgan

(57) ABSTRACT

Fabric softening compositions comprising polymeric materials capable of retaining volatile perfume ingredients are disclosed, as well as methods of softening fabrics.

20 Claims, No Drawings

FABRIC SOFTENING COMPOSITIONS COMPRISING POLYMERIC MATERIALS

BACKGROUND OF THE INVENTION

Perfume is an important component of modern fabric softeners, particularly those delivered through the rinse cycle of a washing machine and those present in dryer sheets and other forms. It is estimated that the cost of perfume may represent about 50% of the overall formula cost of a typical rinse cycle fabric softener. However, there is often a high volume of wasted perfume in the laundry process; instrumental measurements have indicated that about 50 to 70% of the perfume ingredients in a commercial liquid fabric softener typically remain in the washing liquor, and thus are never deposited on the fabrics being treated.

Consequently, increasing perfume deposition efficiency onto fabrics is desirable because it may allow for a significant decrease in waste and cost of a commercial fabric softening product. Furthermore, by improving the deposition efficiency of the volatile ingredients in a perfume, new perfume notes can be introduced into fabric softening compositions and more effectively deposited onto treated fabrics.

In laundry products such as fabric softeners, the presence of a perfume is intended to make the compositions more aesthetically pleasing to consumers. Apart from the point of purchase perception, the perfume additives may impart a pleasant and longer lasting fragrance to fabrics that are treated therewith. However, as noted above, with regard to liquid fabric softening compositions that are added during the laundry process, the major portion of the perfume is often lost in the wash solution during the wash and therefore wasted.

Attempts have been made in the art to increase the efficiency and deposition of perfumes on fabrics. For example, the use of cross-linked cationic vinyl polymers has been discussed and explored in conjunction with fabric conditioning formulations and personal care compositions as a thickening agent, for example in International Patent Publication No. WO 90/12862 and U.S. Pat. No. 4,806,345. Various methods for achieving controlled active release have been developed. One of the simplest of such embodiments is described in Canadian Patent No. 1,111,616 to Young, and U.S. Pat. No. 6,042,792 to Shefer et al., which describe incorporation of perfumes into wax. U.S. Pat. No. 4,464,271 describes encapsulation technology for entrapping softener compositions and fragrance oils in solid particles. An example of such microencapsulation technology is embodied in capsules with perfume, which are broken under friction to provide an instant "burst" of fragrance when the capsules are ruptured.

These types of capsules may behave differently depending on the compositions with which they are used. In particular, they may be disadvantageous in that they can often leak in aqueous compositions containing high levels of surfactants and lower alcohols. As it is desirable to provide perfumed articles that are stable in fluid compositions but still liberate perfume during use, different approaches have been used; for example, building a coating around the particles as described in U.S. Pat. No. 5,137,646, or encapsulating perfume materials together with high C log P solvents to enable the fragrances to remain in the capsules for extended times without leaching from the capsules, as described in European Patent Publication No. 1 533 364 A3. However, there is an ongoing need for the improvement of perfume efficiency and deposition on fabrics and the capture of the more volatile ingredients of a perfume for fabric deposition.

The present invention is directed, in certain embodiments, to a cross-linked polymeric material designed as a perfume "sponge" to retain volatile perfume ingredients. In certain embodiments, the invention is directed to a polymeric material capable of increasing the efficiency of perfume deposition on fabrics such as cotton when used in conjunction with a rinse cycle fabric softening composition.

SUMMARY OF THE INVENTION

A fabric softening composition comprising:

(a) about 0.01% to about 50% of a cationic or nonionic softening compound;

(b) a perfume; and (c) a polymeric material capable of retaining volatile perfume ingredients comprising:

i. at least about 0.001% by weight of a cross-linked polymer comprising at least one vinyl monomer; and ii. about 5,000 to about 100,000 ppm of a divinyl cross-linking agent.

A fabric softening composition comprising a polymeric material capable of retaining volatile perfume ingredients, the polymeric material comprising:

(a) at least about 0.001% by weight of a water dispersible cross-linked cationic polymer derived from the polymerization of about 4% to 80% by weight of a cationic vinyl addition monomer;

(b) about 50% to about 95% by weight of acrylamide; and (c) about 5,000 to about 100,000 ppm of a difunctional vinyl addition monomer cross-linking agent.

A fabric softening composition comprising:

(a) about 2 to about 10% of a fatty ester quaternary ammonium compound;

(b) about 0.01 to about 5% of a fatty alcohol;

(c) about 0.01 to about 2% lactic acid;

(d) about 0.01 to about 5% of a cross-linked polymer; and (e) about 0.01 to about 5% of a perfume chosen from eugenol, phenyl hexanol and hexyl salicylate.

A fabric softening composition comprising a cross-linked polymer comprising:

(a) about 40 to about 60% acrylamide;

(b) about 40 to about 50% of quaternized dimethylaminoethyl methacrylate; and (c) about 3 to about 8% methylene bis-acrylamide cross-linking agent.

A fabric softening composition comprising a polymeric material capable of retaining volatile perfume ingredients comprising:

(a) about 1 to about 99% of styrene or alpha-methyl styrene monomer; and (b) about 5,000 to about 100,000 ppm of divinyl benzene cross-linking agent.

A fabric softenening composition comprising:

(a) about 1 to about 99% of a copolymer of polyether and polyurethane-polyurea;

(b) about 2 to about 10% of a fatty ester quaternary amrnonium compound; and (c) about 0.01 to about 5% of a perfume chosen from eugenol, phenyl hexanol and hexyl salicylate.

In various embodiments, the present invention is directed to methods of softening a fabric comprising contacting the fabric with an effective amount of the fabric softener compositions of the present invention.

DETAILED DESCRIPTION OF THE INVENTION

As used herein, ranges are a shorthand for describing each and every value within a range, including endpoints. All references cited in the present disclosure are hereby incorporated by reference in their entirety. Where there is a conflict between a definition in the present disclosure and that of a cited reference, the present disclosure controls.

The present invention is directed, in certain embodiments, to a fabric softening composition comprising a polymeric material capable of retaining volatile perfume ingredients. By "retaining,"

The present invention is directed, in certain embodiments, to a polymeric material that has the ability to provide increased perfume deposition efficiency. As used herein, the term "perfume deposition efficiency" refers to the proportion of perfume that is retained on the surface of, and/or absorbed in, a material after addition of the perfume of the material, and may be expressed as, for example, log P. In various embodiments, the compositions of the present invention are able to provide a deposition efficiency on fabric of perfume ingredients having a log P below about 3.5 of at least 50%, in contrast with conventional softening compositions where the percentage of deposition of such perfume ingredients is significantly lower. As used herein, the term "perfume" refers to odoriferous materials that are able to provide a pleasing fragrance to fabrics, and may encompass conventional materials commonly used in detergents, fabric softening compositions and other home care uses. For a further discussion of perfumes, see, e.g., U.S. Pat. No. 6,864,223 to Smith et al.

Apart from the economic advantage accruing from an improved perfume deposition efficiency, an improved deposition of perfumes with ingredients having various log P values allows for the formulation and design of various new perfume notes for rinsed fabrics. As used herein, "log P" (also referred to as the "solubility parameter"), refers to the log of the partition coefficient of a compound, where the partition coefficient is ratio of concentration of compound in aqueous phase to the concentration in an immiscible solvent—the index of lipophilicty/hydrophibicity of the compound. For further discussion of log P, see, for example, Sina D. Escher and Esther Oliveros: A Quantitative Study of Factors that Influence the Substantivity of Fragrance Chemicals on Laundered and Dried Fabrics: Journal of American Oil Chemist's Society, Vol. 71, No. 1, pp. 31-40 (1994).

In various embodiments, the polymeric material is contained within a fabric softening composition. In various embodiments, the fabric softening composition further contains at least one fabric or skin beneficiating ingredient, such as perfume contained within a microcapsule having a capsule shell comprising urea formaldehyde or melamine-formaldehyde polymer. The microcapsules may be made of a hard polymeric material that is friable and which ruptures upon gentle rubbing. In this way, an intense burst of fabric or skin beneficiating ingredient can, for instance, be detected on fabric rinsed with a softener composition of the invention during the ordinary manipulation of the fabric. The perfume may then be released at the time the user wears the clothes. Dry towels washed with a fabric softener of the invention have a pleasing fragrance and manifest a particularly intense "fragrance burst" when used.

In certain embodiments, the compositions of the present invention comprise at least about 0.001% by weight of a cross-linked polymer comprising at least one vinyl monomer. In various embodiments, the vinyl monomer is a cationic vinyl monomer. Deposition on fabric such as cotton is enhanced by the presence of vinyl monomers, and examples of useful vinyl monomers include, e.g., diallyl dimethyl ammonium chloride or the quaternized form of dimethylaminoethyl methacrylate.

In certain embodiments, the polymeric material further comprises a polar monomer such as, for example, acrylamide. In various embodiments, the acrylamide may be present in amounts of about 20 to about 95%, about 25 to about 80%, about 30 to about 75% or about 35 to about 70% of the polymeric material.

Certain embodiments of the present invention may additionally comprise a cross-linking agent. In certain embodiments, the cross-linking agent may be a difunctional vinyl addition monomer cross-linking agent. In various embodiments, the difunctional vinyl addition monomer cross-linking agent is methylene bis-acrylamide, a diethylenically unsaturated compound such as, e.g., ethylene glycol di-acrylate, diacrylamide or cyanomethylacrylate.

Copolymers of acrylamide and a cationic monomer may exhibit thickening/structuring properties. These may not always be desirable beyond a certain degree; however, affinity for perfume may result in an increase of the hydrodynamic volume of the copolymer. To prevent uncontrolled thickening and swelling of the copolymers of acrylamide and a cationic monomer, the amount of cross-linking agent may be adjusted to use relatively high amounts as needed, for example, in various embodiments, about 5,000 to about 100,000 ppm, about 10,000 to about 80,000 ppm, about 20,000 to about 70,000 ppm, about 30,000 to about 60,000 ppm or about 45,000 to about 55,000 ppm. In certain embodiments, the amount of cross-linking agent is present in an amount of about 50,000 ppm (i.e., 5%). In certain embodiments, the cross-linking agent is methylene bis-acrylamide. In other embodiments, the cross-linking agent is a divinyl benzene cross-linking agent.

In certain embodiments, the polymeric material comprises a cross-linked polymer that comprises about 47.5% by weight acrylamide, about 47.5% by weight of the quaternized form of dimethylaminoethyl methacrylate and about 5% by weight of methylene bis-acrylamide as cross-linking agent.

In various embodiments, the water dispersible cross-linked cationic polymer is present in amounts of at least about 0.001% by weight, about 2% to 50% by weight, or about 5% to about 35% by weight of the polymeric material.

In certain embodiments, the polymeric material comprises a copolymer of polyether and polyurethane-polyurea. Such a polymer may be commercially available under the tradename Lycra®. In certain embodiments, the present invention is directed to a fabric softening composition comprising:

(a) about 1 to about 99% of a copolymer of polyether and polyurethane-polyurea;

(b) about 2 to about 10% of a fatty ester quaternary ammonium compound; and (c) about 0.01 to about 5% of a perfume chosen from eugenol, phenyl hexanol and hexyl salicylate.

In other embodiments, the polymeric material of the present invention may be loaded with perfume in addition to other ingredients such as, for example, skin beneficial ingredients or foam controlling agents such as, e.g., 2-butyl hexanol.

Embodiments of the present invention can be further illustrated by the following non-limiting Examples:

Example 1

A method of preparation of the polymeric material is to mix 50 grams of the two co-monomers and the cross-linking agent in the proper proportions in 250 mL of a solvent such as benzene, toluene or even tetrahydrofurane (THF). About 2% of a free radical initiator such as azobis isobutyro nitrile (AIBN) is added to the solution. This solution is added drop wise in a spherical flask of 1 L containing 200 mL of the same solvent at its boiling temperature. The spherical flask is fitted with a cooling device to prevent the loss of solvent by evaporation. The polymerization takes place when the solution containing the co-monomers, the cross-linking agent and the free radical polymerization initiator hits the refluxing medium.

After the completion of the addition, the reflux is maintained for an additional 15 minutes, and then allowed to cool. The solvent is removed under reduced pressure, at a temperature not exceeding 60° C. When most of the solvent is removed, the polymer mass is stored overnight in a dessicator under vacuum to remove the rest of the solvent.

A non-stick white power was obtained by adding 5% of cross-linking agent (50,000 ppm). With only 1%, a sticky, elastic mass was obtained.

Preparation of the Perfume-Polymer Premix:

The process is similar to the one of a normal since cycle fabric softener, except that the perfume is replaced by a perfume-polymer premix which could be obtained following two processes:

mix of polymer and fragrance without water mix of polymer, fragrance and water

Assuming the cross-linked copolymer is at 25% in water, 50 grams of polymer gel (12.5 g polymer) are mixed with 6.25 g perfume for at least 2 hours. The ratio of polymer and perfume has to be adjusted, between 50:1 and 1:50, preferably between 10:1 and 1:10. The proportion of the perfume-polymer premix has to be adjusted too, between 0.01 to 20%.

The perfume-polymer premix can be introduced in the formula at different stages, for example:

In the esterquat-fatty alcohol premix

Just after the esterquat premix

In post-addition; or

In hot water before the esterquat premix.

Example 2

A polymeric material was prepared as follows: A mixture of melamine-formaldehyde and urea-formaldehyde resins were cross-linked with a copolymer of maleic anhydride and methyl vinyl ether (commercially known as Gantrez). Capsules were prepared with the above material and three perfume ingredients selected according to their log P (eugenol, phenyl hexanol and hexyl salicylate). The capsules were formulated within a fabric softener, and their ability to deposit on cotton was evaluated.

Table 1 shows the amount of perfume molecules that remained deposited on the cotton from a fabric softener containing the capsules one day after the formulation of the fabric softener, compared with the same fabric softener in which the fragrance molecules were not encapsulated with the polymeric material. The difference between the amount deposited for encapsulated versus non-encapsulated polymeric material was found to be large for eugenol and phenyl hexanol (which have low to medium log P values), and smaller for hexyl salicylate (which has a higher log P value). This suggests that encapsulation has a greater potential impact on deposition of higher log P perfumes such as hexyl salicylate, than of lower to medium log P perfumes such as eugenol or phynyl hexanol.

TABLE 1

| | μg/g cotton (with capsules) | μg/g cotton (non-encapsulated) |
|---|---|---|
| Eugenol (log P = 2.3) | 53 | None detected |
| Phenyl Hexanol (log P = 3.3) | 55 | 22 |
| Hexyl Salicylate (log P = 5.26) | 65 | 52 |

When the same measurements were made again after 2 weeks, results indicated that there was no longer any a detectable difference between the perfume levels encapsulated and non-encapsulated formulations.

The capsules were then reformulated with a copolymer of polyether and polyurethane-polyurea (commercially available as Lycra) polymeric fiber material. Various amounts of the polymeric material (about 1 g to about 5 g) were dispersed in 100 g regular fabric softener compositions containing about 3.6% esterquat and about 0.38% of perfume (either eugenol, phenyl hexanol or hexyl salicylate). The containers were shacked for 16 hours to allow the systems to equilibrate. The polymeric material was then removed, and the esterquat was tested for perfume molecule content (via dosing by HPLC). Table 2 shows the proportion of perfume molecule extracted from the esterquat aggregates to the polymeric material fibers, i.e., the proportion of the perfume that was absorbed by the polymeric material.

TABLE 2

| | 1.0 g polymeric material | 3.1 g polymeric material | 5.0 g polymeric material |
|---|---|---|---|
| Eugenol | 0.24 | 0.45 | 0.57 |
| Phenyl Hexanol | 0.26 | 0.51 | 0.60 |
| Hexyl Salicylate | 0.34 | 0.63 | 0.69 |

Results indicate that when the polymeric material is present, the perfume migrates from the esterquat to the polymeric material.

The formulation was varied to use the copolymer of polyether and polyurethane-polyurea in powder form (rather than fiber form). Results were similar, with slightly less efficient deposition on cotton, probably due to the escape of perfume during fabric drying. To improve deposition and reduce perfume loss during drying, the perfume-loaded particles were coated with an aminoplast shell (composed of a blend of melamine-formaldehyde and urea-formaldehyde resins crosslinked with a copolymer of maleic anhydride and methyl vinyl ether, which is commercially known as Gantrez).

Example 3

The nature of the polymeric material may be varied to optimize the perfume absorption. Accordingly, the polyether may be poly tetramethylene oxide (PTHF), polyethylene oxide, polypropylene oxide or binary or ternary polymers thereof. The molecular weight of the polyether segments may be varied from about 300 to about 10,000. The length of the polyurethane-polyurea segments can accordingly be varied. Polyamide segments may also be used.

Example 4

Polystyrene cross-linked with divinyl benzene was explored as the polymeric material. The partition coefficient of perfume molecules between such cross-linked polystyrene coated with an aminoplast shell (commercially available as Serdolit III) and esterquat was evaluated. Results showed that polystyrene has a high affinity for perfume. When the polystyrene beads were soaked in a perfumed rinse cycle fabric softener composition, they were expected to pump the perfume out of the quat vesicles. A soaking test was conducted, various amounts of beads (0.25%, 0.5% and 1%) were added to a rinse cycle fabric softener containing 3.6% EQ and 0.38% of a perfume trio (eugenol, phenyl hexanol and hexyl salicylate). Results showed that the partition coefficients (and therefore, affinity to perfume) of the polymer material comprising polystyrene was much higher than that of the copolymer of polyether and polyurethane, as shown in Table 3:

TABLE 3

| | Partition Coefficient of Copolymer of polyether and polyurethane | Partition Coefficient of Polystyrene Material |
|---|---|---|
| Eugenol | 1.0 | 6.7 |
| Phenyl Hexanol | 1.1 | 10.3 |
| Hexyl Salicylate | 1.4 | 6.7 |

Example 5

Table 4 shows the proportion of perfume molecules that remained deposited on the cotton surface from a fabric softening composition containing 1 and 3% cross-linked polystyrene after the formulation of the fabric softening composition:

| | | Boiling Point | Polystyrene Concentration | | |
|---|---|---|---|---|---|
| | Log P | (° C.) | 0% | 1% | 3% |
| Hexyl Salicylate | 5.26 | 290 | 88 | 87 | 88 |
| Phen Hexanol | 3.30 | 258 | 48 | 64 | 80 |
| Eugenol | 2.30 | 253 | 20 | 42 | 71 |
| Nerol | 2.65 | 227 | 13 | 42 | 69 |
| Linalool | 2.43 | 196 | 1.4 | 33 | 61 |

Table 4 clearly shows the benefit of using cross-linked polystyrene in the delivery of medium to low log P perfume. Results were particularly dramatic for perfumes that are more volatile (have a lower boiling point); perfumes such as nerol and even more, linalool, which do not deposit efficiently alone, were shown to deposit much better in the presence of polystyrene.

We claim:

1. A fabric softening composition comprising:

(a) about 0.01% to about 50% of a cationic or nonionic softening compound;

(b) a perfume; and (c) a polymeric material capable of retaining volatile perfume ingredients comprising:

i. at least 0.001% by weight of a cross-linked polymer comprising diallyl dimethyl ammonium chloride; and ii. about 5,000 to about 100,000 ppm of a divinyl cross-linking agent.

2. The fabric softening composition of claim 1, wherein the cross-linked polymer is a water dispersible, cationic polymer derived from the polymerization of about 4% to about 80% by weight of diallyl dimethyl ammonium chloride.

3. The fabric softening composition of claim 2, wherein the polymeric material further comprises about 20% to about 95% by weight of acrylamide.

4. The fabric softening composition of claim 1, wherein the polymeric material has a crosslinking density of about 5 to about 10%.

5. The fabric softening composition of claim 1, wherein the cross-linked polymer of the polymeric material is water dispersible, water swellable or water soluble.

6. The fabric softening composition of claim 1, wherein the polymeric material is capable of absorbing at least 2% of its weight of volatile perfume ingredients.

7. The fabric softening composition of claim 6, wherein the polymeric material is capable of absorbing at least 5% of its weight of volatile perfume ingredients.

8. The fabric softening composition of claim 1, wherein the divinyl cross-linking agent in the polymeric material is present in an amount of about 20,000 to about 70,000 ppm.

9. The fabric softening composition of claim 1, further comprising at least one fabric or skin beneficiating ingredient contained within a microcapsule, the capsule shell comprising urea formaldehyde or melamine-formaldehyde polymer.

10. The fabric softening composition of claim 9, wherein the microcapsule is an aminoplast microcapsule.

11. The fabric softening composition of claim 1, comprising a cationic softening compound chosen from difatty dialkyl quaternary ammonium compounds; fatty ester quaternary ammonium compounds; alkyl imidazolinium compounds; and fatty amide quaternary ammonium compounds.

12. The fabric softening composition of claim 1, comprising a nonionic softening compound chosen from a fatty amidoamine or fatty esteramine.

13. The fabric softening composition of claim 1, further comprising up to about 5% by weight of a non-confined fragrance oil.

14. The fabric softening composition of claim 1, wherein the composition provides a deposition efficiency on fabric of perfume ingredients having a log P below about 3.5 of at least 40%.

15. The fabric softening composition of claim 14, wherein the composition provides a deposition efficiency on fabric of perfume ingredients having a log P below about 3.5 of at least 50%.

16. The fabric softener composition of claim 1, in the form of a liquid, gel, powder or dryer sheet.

17. The fabric softener composition of claim 1, wherein the cationic or nonionic softening compound comprises about 2 to about 10% by weight of a fatty ester quaternary ammonium compound, the polymeric compound is present at about 0.01 to about 5% by weight, and further comprises about 0.01 to about 5% by weight of a fatty alcohol;

about 0.01 to about 2% by weight lactic acid; and about 0.01 to about 5% by weight of a perfume chosen from eugenol, phenyl hexanol and hexyl salicylate.

18. The composition of claim 17, further comprising an ingredient chosen from a preservative, a sequestering agent, a surfactant, or a nonionic, anionic or cationic co-monomer.

19. A method of softening a fabric comprising contacting the fabric with an effective amount of the fabric softener composition of claim 1.

20. The method of claim 19, wherein the contacting is accomplished through spraying, rubbing or rinsing.

* * * * *